United States Patent [19]

Closmann

[11] 3,957,306

[45] May 18, 1976

[54] EXPLOSIVE-AIDED OIL SHALE CAVITY FORMATION

[75] Inventor: Philip J. Closmann, Houston, Tex.

[73] Assignee: Shell Oil Company, Houston, Tex.

[22] Filed: June 12, 1975

[21] Appl. No.: 586,320

[52] U.S. Cl. ..... 299/4; 166/272; 166/299

[51] Int. Cl.[2] ..... E21B 43/24; E21B 43/26

[58] Field of Search ..... 166/299, 63, 271, 272, 166/259; 299/4, 5, 10, 13; 102/22, 23

[56] References Cited

UNITED STATES PATENTS

| | | | |
|---|---|---|---|
| 3,002,454 | 10/1961 | Chesnut | 166/299 |
| 3,434,757 | 3/1969 | Prats | 299/13 X |
| 3,533,471 | 10/1970 | Robinson | 166/299 |
| 3,616,855 | 11/1971 | Colgate | 166/299 X |
| 3,759,574 | 9/1973 | Beard | 299/4 |
| 3,771,600 | 11/1973 | Hill | 166/299 |
| 3,779,602 | 12/1973 | Beard et al. | 299/5 |
| 3,822,916 | 7/1974 | Jacoby | 299/4 |

*Primary Examiner*—Stephen J. Novosad

[57] ABSTRACT

The forming of a rubble-containing cavity within a subterranean oil shale is improved by: leaching water-soluble minerals to form an areally extensive void in or above an upper portion and an areally extensive permeable zone or void within or contiguous with a lower portion of the oil shale; displacing an explosive fluid into the lower permeable zone; and detonating the explosive.

6 Claims, 4 Drawing Figures

EXPLOSIVE-AIDED OIL SHALE CAVITY FORMATION

BACKGROUND OF THE INVENTION

The invention relates to producing shale oil and related mineral materials from subterranean deposits of oil shale.

Numerous subterranean oil shales are mixed with water-soluble minerals. Such shales comprise substantially impermeable, kerogen-containing, earth formations from which shale oil can be produced by a hot fluid-induced pyrolysis or thermal conversion of the organic solids to fluids. A series of patents typified by the T. N. Beard, A. M. Papadopoulos and R. C. Ueber U.S. Pat. Nos. 3,739,851; 3,741,306; 3,753,594; 3,759,328; 3,759,574 describe procedures for utilizing the water-soluble minerals in such shales to form rubble-containing caverns in which the oil shale is exposed to a circulating hot aqueous fluid that converts the kerogen to shale oil while dissolving enough mineral to expand the cavern and expose additional oil shale.

In such oil shales significant amounts of time and energy may be consumed in forming a rubble-containing cavity. Such deposits are both impermeable and poor conductors of heat. Even where such an oil shale is relatively rich in water-soluble mineral, years of circulating hot aqueous fluid may be required to leach out a rubble-containing cavity that exposes enough oil shale to be economically useful. In such operations the rates of rubbling and leaching become slower as the cavity becomes larger. And, such rates are slower where the original concentration of soluble minerals in the oil shale is lower.

In general, such a rubble-containing cavity should have a radius in the order of at least about 50 feet; preferably, at least about 100 feet. The cavity height should approximate the thickness of the oil shale deposit and should be at least about 200 feet; preferably, at least about 500 feet. The leaching and dissolving action should also be made severe enough or continued long enough to cause chunks of oil shale (in the cavity and along the inner walls of the cavity) to have a permeability of at least about 1 and preferably at least about 10 darcies.

In a typical deposit, the oil shale formation might be about 500 feet thick, might contain about 25 percent by weight nahcolite in a relatively uniform distribution, and might contain enough kerogen to provide a Fischer assay richness of about 25 gallons per ton. A borehole might be drilled through the oil shale and underreamed or drilled to a diameter of about 2 feet. If a relatively fresh water, heated to about 300°F, were to be circulated through the cavity at about 10,000 barrels per day, about 4 years would probably be required to form a rubble-containing cavity having a diameter of about 200 feet and a height of about 500 feet. Such a rate of growth might be improved somewhat by a cavity-expanding and solids-removing optimization of the type described in the T. N. Beard and P. VanMeurs U.S. Pat. No. 3,779,602 and/or the L. H. Towell and J. R. Brew U.S. Pat. No. 3,792,902. In those processes the hot water is circulated at a pressure optimized for enhancing growth without unduly increasing carbonate precipitation and/or fresh aqueous fluid is mixed with downhole portions of outflowing solution to prevent precipitation in the production tubing string as the pressure and temperature decrease at shallower depths.

Text books published as early as 1946 indicate that "well shooting", to create permeability by detonating explosives was used where the reservoir rocks were hard and well cemented; see "Petroleum Production Engineering, Oil Field Development, also Oil Field Exploitation" by L. C. Uren, McGraw Hill Book Company, 1946. U.S. Pat. No. 3,533,471 indicates that, in hard rock, the extent of fragmentation can be improved by forming generally parallel fractures, propping them open with a granular propping material, injecting as explosive liquid into one, and detonating the explosive so that the shock waves are reflected from the discontinuity formed by the other fracture. The R. T. McLamore U.S. Pat. No. 3,637,020 describes the use of conical notches and shaped explosive charges to enhance the tendency for fractures, in hard formations, to be horizontal. U.S. Pat. Nos. 3,561,532; 3,587,744 and 3,593,793 describe various explosive liquids and methods of emplacing them in hard formations to increase permeability by well shooting. The P. J. Closmann and Helmer Ode U.S. Pat. No. 3,448,801 describes an enlargement of a nuclear chimney within a subterranean oil shale. Lower energy explosives in surrounding locations are detonated between the time the chimney is expanding radially outward and the time its roof collapses into rubble.

Subterranean oil shales, such as those containing or associated with water-soluble minerals, are relatively highly compressible. Compressible materials tend to absorb or damp-out direct or reflected shock waves without undergoing much if any fragmentation. However, the present invention is, at least in part, premised on the discovery that in such a subterranean oil shale formation, the combination of (a) the relatively high degree of shock wave energy reflection from a cavity that is substantially free of any solids that are rigidly held by lithostatic pressure, and (b) the relatively free movement of displaced and reoriented rock pieces into such a cavity, can cause enough fragmentation to significantly enhance the rate at which a rubble-containing cavity can be solution-mined before or while shale oil is recovered.

SUMMARY OF THE INVENTION

This invention relates to an improved process for forming a rubble-containing cavity within a water-soluble-mineral-containing subterranean oil shale. A relatively areally extensive void is formed in or above an upper portion of the oil shale by selectively leaching solids from a water-soluble mineral-rich layer in that location. A relatively areally extensive permeable zone and/or void is formed within or contiguous with a lower portion of the oil shale by selectively leaching solids from a relatively water-soluble mineral rich zone in that location. And, an explosive is displaced into the lower void or permeable zone and detonated, to fragment the adjacent oil shale by the action of the direct and reflected shock waves and the displacement of solids into the cavity.

DESCRIPTION OF THE INVENTION

Figure 1:
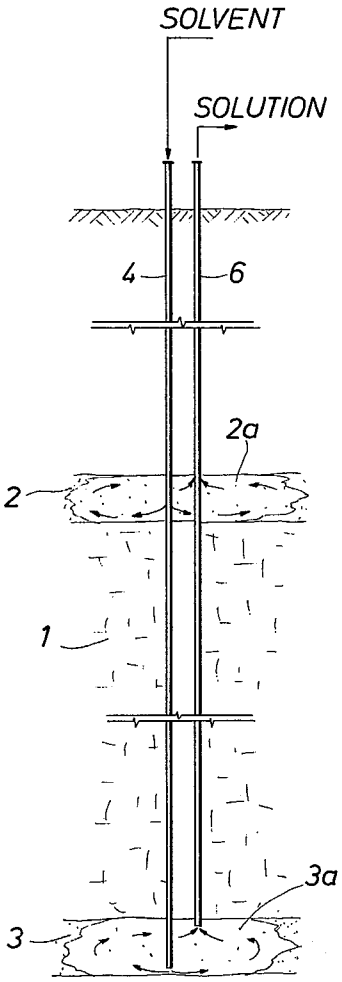
FIGS. 1 to 4 are schematic illustrations of the present process in different stages of its application to a subterranean oil shale deposit.

As used herein "oil shale" refers to a substantially impermeable aggregation of inorganic solids and a predominately hydrocarbon-solvent-insoluble organic-solid mateial known as "kerogen". "Bitumen" refers to the hydrocarbon-solvent-soluble organic material that may be initially present in an oil shale or may be formed by a thermal conversion or pyrolysis of kerogen. "Shale oil" refers to gaseous and/or liquid hydrocarbon materials (which may contain trace amounts of nitrogen, sulfur, oxygen, or the like) that can be obtained by distilling or pyrolyzing or extracting organic materials from an oil shale. "Water-soluble inorganic mineral" refers to halites or carbonates, such as the alkali metal chlorides, bicarbonates or carbonates, which compounds or minerals exhibit a significant solubility (e.g., at least about 10 grams per 100 grams of solvent) in generally neutral aqueous liquids (e.g., those having a pH of from about 5 to 8) and/or heat-sensitive compounds or minerals, such as nahcolite, dawsonite, trona, or the like, which are naturally water-soluble or are thermally converted at relatively mild temperatures (e.g., 500° to 700°F) to materials which are water soluble. The term "water-soluble-mineral-containing subterranean oil shale" refers to an oil shale that contains or is mixed with at least one water-soluble inorganic mineral, in the form of lenses, layers, nodules, finely-divided dispersed particles, or the like. A "cavern" or "cavity" (within an oil shale formation) refers to a relatively solids-free opening or void in which the solids content is less than about 60% (preferably less than about 50%) and substantially all of the solids are fluid-surrounded pieces which are substantially free of the lithostatic pressure caused by the weight of the overlying rocks.

The material and compositions used in individual steps, such as leaching water-soluble minerals, displacing explosive fluids into the resultant void spaces or permeable zones, and the detonation of the explosive fluids, can be conducted by means of the compositions and techniques known to those skilled in the art.

The present invention is particularly applicable to regions of the Piceance Basin of Colorado in which significant intervals of oil shale are overlaid by two halite beds. One such bed the "Lower Halite Zone" is in or adjacent to the upper portion of a relatively thick layer of normally impermeable water-soluble-mineral-containing oil shale. The "Upper Halite Zone" is located considerably higher, near a portion of oil shale that has been naturally water-leached to become an aquifer capable of delivering large amounts of water. In these regions the oil shale layer is commonly about 500 or more feet thick and usually contains or is contiguous with the "Greeno" layer of nahcolite. In addition, there is a significant amount of nahcolite throughout the oil shale interval, particularly along the bedding planes. The Greeno layer often maintains a thickness of several feet for areal distances in the order of miles. The Lower Halite Zone is similarly relatively thin and significantly areally extensive.

FIG. 1 shows an early stage of the application of the present process to such a portion of an oil shale deposit. A relatively thick layer of oil shale 1 contains an overlying or upper-portion-located halite layer 2, and a lower-portion-located nahcolite-rich zone 3. At least one well is drilled into those layers and is equipped with conduits 4 and 6. Such conduits can be installed in one or more boreholes and arranged, by means of packers or the like, to selectively conduct fluids into and out of the layers 2 and 3. As shown by the arrows, a solvent, such as a hot aqueous fluid, is inflowed through conduit 4 and outflowed through conduit 6 to selectively leach-out an areally extensive void 2*a* in the halite layer 2 and areally extensively void or permeable zone 3*a* in the nahcolite rich zone 3.

Figure 2:
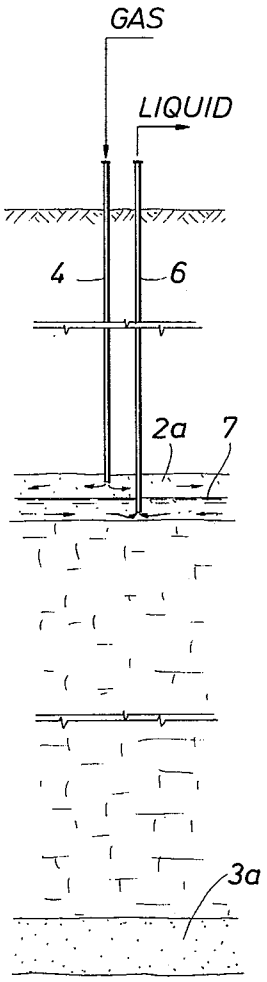

FIG. 2 shows a particularly preferred embodiment in which a low density, highly compliant fluid, such as a gas or a relatively light hydrocarbon, is displaced into an upper portion of the zone 2*a* while the aqueous liquid used to solution-mine that void is displaced out through conduit 6. Such a displacement is preferably continued until the gas/oil interface 7 is substantially contiguous with the bottom of the void.

Figure 3:
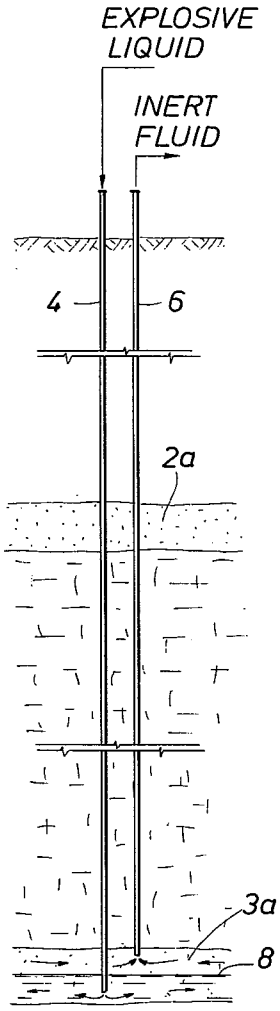

In the stage shown in FIG. 3, an explosive liquid having a relatively high density is flowed into a bottom portion of the cavity 3*a*. This displaces fluid, such as the aqueous solution remaining after the formation of the void or permeable zone, out through conduit 6. Such a displacement is preferably continued until the interface 8 between the explosive liquid and the inert fluid is substantially contiguous with the top of the zone.

The so-displaced explosive liquid is detonated, for example, by conventional means.

Figure 4:
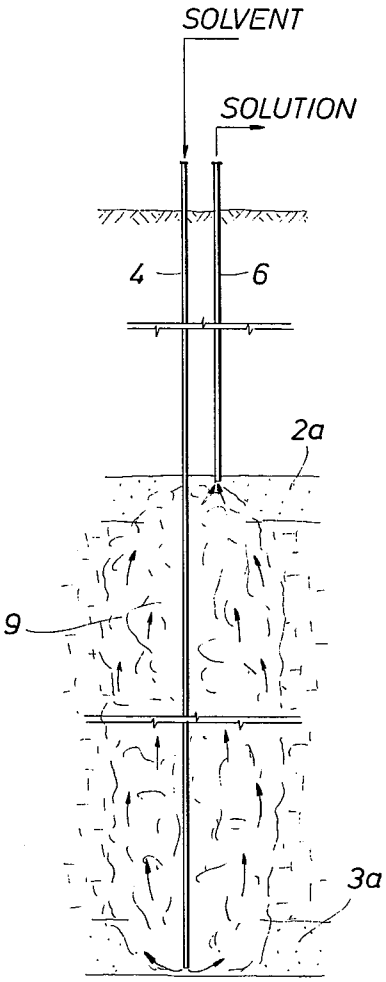

FIG. 4 shows a relatively extensive fragmented zone 9 resulting from such a detonation. The well borehole of the one or more wells is redrilled or cleaned out to the extent necessary and conduits 4 and 6 are reinstalled and arranged for circulating a solvent in and a solution out. The solvent is preferably a hot aqueous liquid which is injected near the bottom of the fragmented zone. The solution is preferably withdrawn from near the top of the fragmented zone.

As known to those skilled in the art, the mineral dissolved during the solution mining or leaching operations can be recovered and can provide valuable by-products to the subsequent recovery of shale oil. In general, during such leaching processes, some, but relatively small amounts of, shale oil are entrained with and can be recovered from the outflowing solutions.

What is claimed is:

1. In forming a rubble-containing cavity in a water-soluble-mineral-containing subterranean oil shale, the improvement comprising:

forming a relatively areally extensive void in or above an upper portion of the oil shale by selectively leaching solids from a water-soluble mineral-rich layer in that location;

forming a relatively areally extensive permeable zone or void in or continguous with a lower portion of the oil shale by selectively leaching solids from a water-soluble mineral-rich layer in that location;

displacing explosive liquid into the lower void or permeable zone;

displacing fluid having a relatively low density and high compressibility into the upper void; and subsequently, detonating the explosive to fragment the adjacent shale by the combined action of direct and reflected shock waves and solids-displacement.

2. The process of claim 1 in which the low density fluid is a gas.

3. The process of claim 2 in which the subterranean oil shale is in the Piceance Basin and the overlying water-soluble mineral-rich layer is the Lower Halite layer.

4. The process of claim 3 in which the lower-positioned water-soluble mineral-rich layer is the Greeno nahcolite layer.

5. The process of claim 4 in which at least one relatively areally extensive void is leached in a nahcolite-rich layer between the halite and Greeno layers and explosive is displaced into and detonated within the so-leached layer.

6. The process of claim 1 in which the displacing in and detonating of liquid explosive is repeated at least one time.

* * * * *